US005095680A

United States Patent [19]

Guardiola

[11] Patent Number: 5,095,680

[45] Date of Patent: Mar. 17, 1992

[54] FILLING CONTAINERS WITH PRODUCTS IN A PREDETERMINED DISTRIBUTION

[75] Inventor: Agustin D. Guardiola, Badalona, Spain

[73] Assignee: Talleres Daumar S.A., Barcelona, Spain

[21] Appl. No.: 633,086

[22] Filed: Dec. 20, 1990

[51] Int. Cl.[5] ..... B65B 5/10; B65B 39/14

[52] U.S. Cl. ..... 53/244; 53/250; 53/255; 53/263; 414/788.9; 414/790.9; 414/793

[58] Field of Search ..... 53/246, 250, 251, 244, 53/534, 543, 154, 237, 255, 263; 414/788.9, 789.1, 792.9, 793, 744.3, 790.9

[56] References Cited

U.S. PATENT DOCUMENTS 3,951,274 4/1976 Yamamoto ..... 53/244 X
4,722,169 2/1988 DeSantis ..... 53/251 X
4,974,391 12/1990 Blum et al. ..... 53/244 X

*Primary Examiner*—John Sipos
*Assistant Examiner*—Linda B. Johnson
*Attorney, Agent, or Firm*—Lackenbach Siegel Marzullo & Aronson

[57] ABSTRACT

Machine for filling containers with products, in a predetermined distribution includes simultaneous feed means, with as many vibratory ducts transporting respective rows of products and with corresponding unit supports thereof; at least one rotating frame with vertical pneumatic cylinders and with as many lower suction cups at their pistons, communicating with sources of vacuum; a carriage with alternating transverse displacement, with means of longitudinal advance for at least one pair of containers and with transverse barrier and constraint means for the products, both coordinated; and a process programming unit.

3 Claims, 15 Drawing Sheets

FILLING CONTAINERS WITH PRODUCTS IN A PREDETERMINED DISTRIBUTION

FIELD OF THE INVENTION

The present invention relates to a machine for filling containers with products, in a predetermined distribution, which contributes, to the function for which it is intended, various advantages to be described below, apart from other advantages inherent in its organization and makeup.

BACKGROUND OF THE INVENTION

Known are machines for filling containers, and more specifically boxes (hence commonly called boxing machines), with diverse products, in particular fruits and certain vegetables and in general more or less round plant products, which are packed in wooden or cardboard boxes. Among these machines some pick up and transport the products by the suction caused by vacuum, for which purpose they include devices provided with suction cups that are flexible in the degree required by the greater or lesser resistance of the surface of the products to be handled, to ensure maximum contact between the suction cups and the products, in order to limit losses of vacuum.

With said type of machines there are formed layers of fruits or other more or less round products in boxes or the like, in predetermined geometric arrangements normally designed so that the units of such products adjust themselves in each layer and so as to stabilize the contents of the box with a view to its transportation and to obtain a good appearance at the point of sale, in case the product is offered directly with the box open for display to the buying public.

The known type of machine referred to operates by transferring the fruits from supply means to the respective box, which in turn is conveyed by transporting means, thereby automating the filling process previously carried out manually. Said transfer is made by using simultaneously multiple suction cups which, in each operation, transport a complete layer or a complete row of fruits; and the box is lowered to transfer the next layer of fruit on top, when filling with more than one layer.

If a complete layer is transferred, the machine must have two transfer stations for a single box, to be able to pack two different and mutually complementary arrangements of superposed layers; this makes the machine more expensive, increases the space occupied by it, raises the handling cost, and in particular necessitates changing various elements and devices and making various adjustments in order to adapt the machine—within certain limits imposed by its functional organs and structure—to the different spatial distributions of the fruits in their containers and to the various sizes of the latter. All this taking into account the peremptory and ever changing requirements, even within the same day, that may in the practice present themselves to the user of these machines, with the consequent delays, which amount to a reduction in output and to additional labor costs for such adaptation to the practical needs.

If a complete row of fruits is transferred, something similar occurs; in a variant, the machine has devices which stop the passage of vacuum to the suction cup or cups needed for the desired complementary configuration in alternate rows of one and the same layer, with the same or similar disadvantages.

SUMMARY OF THE INVENTION

The machine for filling containers with products in a predetermined distribution, according to the present invention, is of the type which comprises a means of supplying the products to be packed, a means of transporting the products by suction from their supply zone to their place in the respective container, in a special, orderly and predetermined distribution, and another means for transporting the containers for filling and for their exit when full, also comprising a structure for supporting the elements of the machine, means for actuating the respective elements, and control, adjustment and drive means. This machine is characterized in that it presents at least a pair of simultaneous feed means, ending in as many vibratory transport ducts, each of which arranges the products in a row and discharges them, one by one, onto a concave support whose bottom is formed by a vibratory brush; in that the product transporting means consists of at least one frame rotating about a vertical axis, with a step-by-step movement and by an angle equal to the resuslt of dividing 360° by twice the total number of concave supports and then multiplying by the number of rotating frames, said vertical axis being situated at a point equidistant from the centers of the respective concave supports, and in the frame are mounted vertical pneumatic cylinders disposed peripherally equidistant from each other and at an angle equal to that of the step-by-step rotation of the frame and connected to respective solenoid valves communicating with a source of compressed air, which pistons are tubular and communicate by their upper end with respective sources of vacuum, which in turn are connected to respective solenoid valves linked to said source of compressed air, and said pistons have at their lower open end as many suction cups preferably in the from of bellows; in that the container transporting means comprises means for longitudinal advance toward the exit of the machine, mounted on a carriage provided with means for alternate transverse displacement and with at least one pair of transverse barrier means coordinated with as many containers to be filled, to keep the products in position while the rows of each layer are being made in at least one pair of juxtaposed containers being filled simultaneously, and said carriage is provided also with at least one pair of upper transverse holding means of each row of products formed in each of said pairs of juxtaposed containers, the holding means having as many means for their alternate longitudinal displacement, and the movement of the containers toward the exit being coordinated with the intermittent forward movement of the containers being filled, with a displacement equal to the separation between the axes of a product row relative to the next one to be formed and with an inactive retrocession of equal value for holding the next row, after it is formed; and in that it presents a process programming unit which controls and regulates the various operating phases, including various selective spatial distributions of the products in the containers in accordance with the capacity thereof.

The machine for filling containers with products in a predetermined distribution, according to the present invention, eliminates the mentioned drawbacks of the known machines and offers the advantages, among others, deriving from its versatility in that it can handle products and containers of different sizes and proportions, and in that it can vary the spatial distribution of the products in their respective container, that is, the configuration of each layer of products and that of the layers among themselves, all in an easy, sure and quick manner for the user of this machine; also, the vibratory ducts for transporting the products and the concave supports with their vibratory brushes position the products in case they are more or less flattened, such as mandarins, with their flat base resting on the respective concave support, which position will be maintained until such products are discharged onto the respective container being filled, thereby improving the visual appearance of the box when full, with a view to its display to the buying public.

The machine for filling containers with products according to the present invention offers the advantages described above, besides others which will be readily evident from the example of realization of said machine, described in greater detail below, to facilitate the comprehension of the above stated characteristics, showing at the same time various details and for that purpose attaching hereto drawings which show, by way of example only and not limiting the scope of the present invention, a practical case of the machine for filling containers with products in a predetermined distribution, according to the invention.

DETAILED DESCRIPTION OF THE PREFERRED EMBODIMENTS

As shown in said drawings, the machine for filling containers with products in a predetermined distribution and according to the depicted example of realization comprises a structure or frame (1) for supporting and securing the various elements thereof, permitting the machine to rest, possibly adjustable in height, on the floor where it is installed, and also permitting, if desired, its attachment to the floor; by such frame (1) is to be understood also the top part of the machine, in particular with respect to the upper structure thereof which presents, among other elements, the means of supplying the products to be packed and the means of transporting the products from said feed means to the respective containers to be filled.

The part of the machine corresponding to the entrance of the containers to be filled will be called its front, while the part corresponding to the exit of said containers, now filled with the respective products, is its rear.

Figure 4:
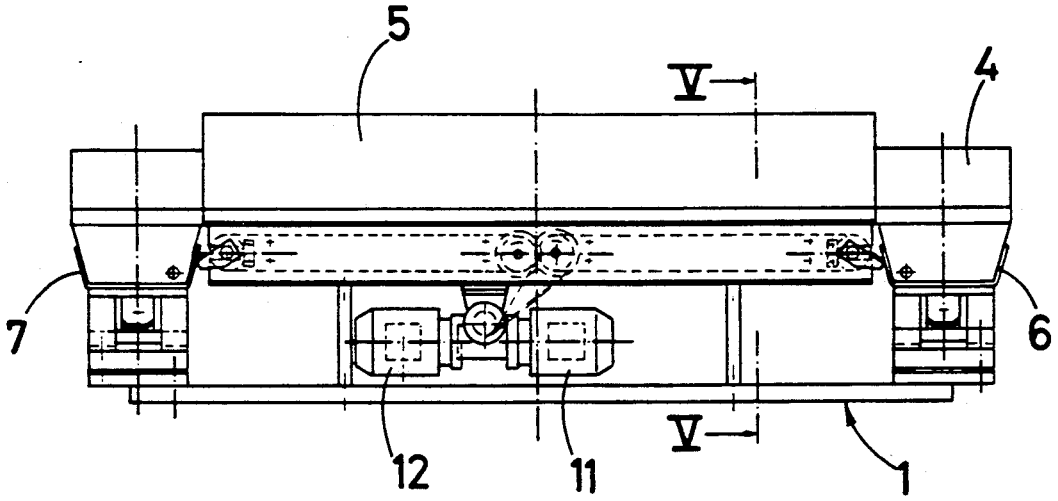
FIGS. 4, 5 and 6 represent, respectively, the means for supplying the products, as seen in a section along IV—IV of FIG. 6, in section along V—V of FIG. 4, and in plan.
Figure 5:
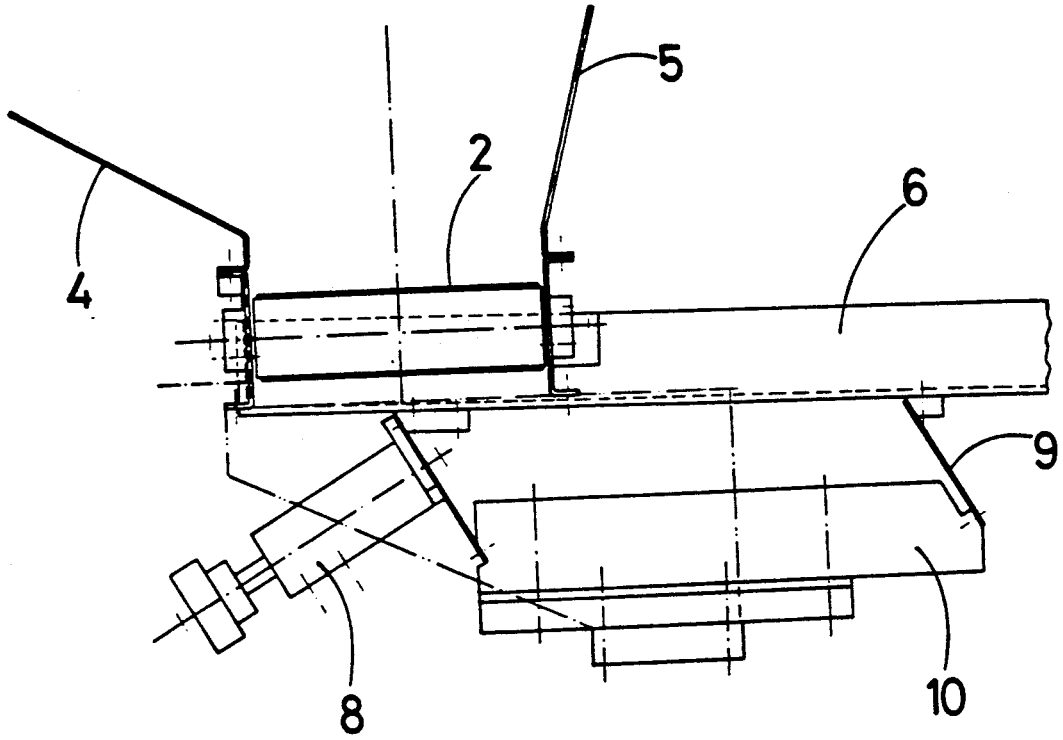
Figure 6:
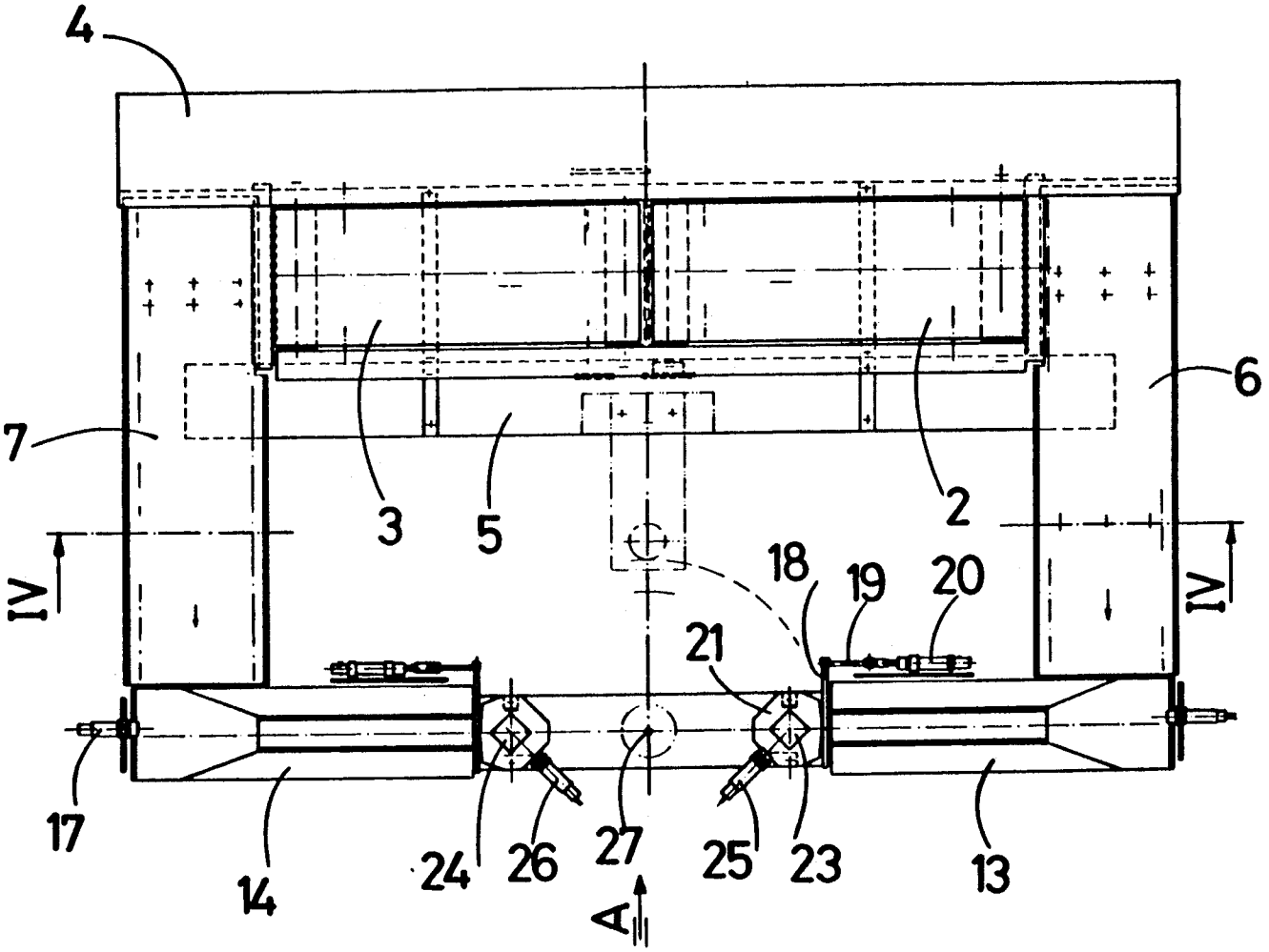

At the exit of the filling machine and at a greater height than corresponds to the exit of the filled boxes there is arranged, in this example of realization, a pair of simultaneous feed means, comprising two endless conveyor belts (2) and (3), an oblique wall (4) for receiving the products which extends transversely over the full width of this part of the machine, coupled to the installation in which this machine is set up, and another wall (5) for containing on this side the transported products, which wall is less inclined in this case than wall (4), all of which is seen especially in FIGS. 4, 5 and 6.

The two simultaneous feed means in question finish and discharge the products into as many vibratory ducts (6) and (7), there being arranged in the transition zones between each endless belt (2) and (3) and said ducts (6) and (7) detectors for controlling the stopping and running of said two endless belts, setting them in motion when no product is detected at the heads of the vibratory ducts and stopping them when said ducts are filled with products.

In FIG. 5 is seen a vibrator (8), in this case a pneumatic one corresponding to duct (6); it is mounted floating, that is, so as to permit its vibration, through elastic plates such as plate (9), which are joined at their upper end to said vibratory ducts and by their lower end to a balance weight (10).

The endless belts (2) and (3) are driven by respective motors (11) and (12), possibly through corresponding reducers, transmissions and pinions or pulleys, each motor group with its driving elements being disposed in this example on either side of each of the two belts, to occupy less space as a whole.

The vibratory ducts (6) and (7), in turn, open into as many narrow ducts, also vibratory, disposed transversely relative to the longitudinal axis of the machine; while the ducts (6) and (7) are arranged longitudinally and the endless belts (2) and (3) are disposed also transversely (FIG. 6).

Figure 7:
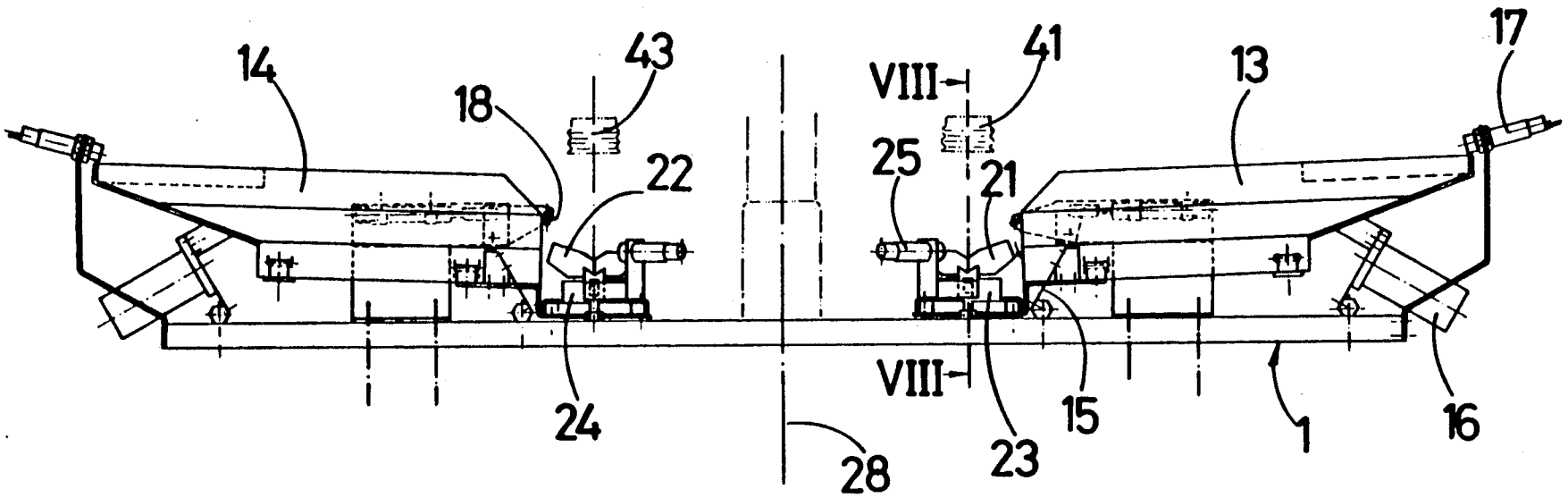
FIGS. 7 and 8 represent, respectively, a front view along A of FIG. 6 and a section along VIII—VIII of FIG. 7.

These narrow vibratory ducts (13) and (14) are mounted floating just as stated with respect to the vibratory ducts (6) and (7), with elastic plates such as plate (15) —FIG. 7— and are actuated by as many vibrators such as (16), which may be pneumatic, just as vibrator (8) of the vibratory ducts (6) and (7) and the latter may possibly carry a counterweight.

In each duct (13) and (14) a detector is provided such as detector (17) for controlling the supply of the products that are being handled and each mentioned duct presents, at its product exit end, a stop such as the bar stop (18) which, through an articulated plate such as plate (19), is hinged to the stem of a cylinder such as the pneumatic cylinder (20) —FIGS. 6 and 7—.

Figure 8:
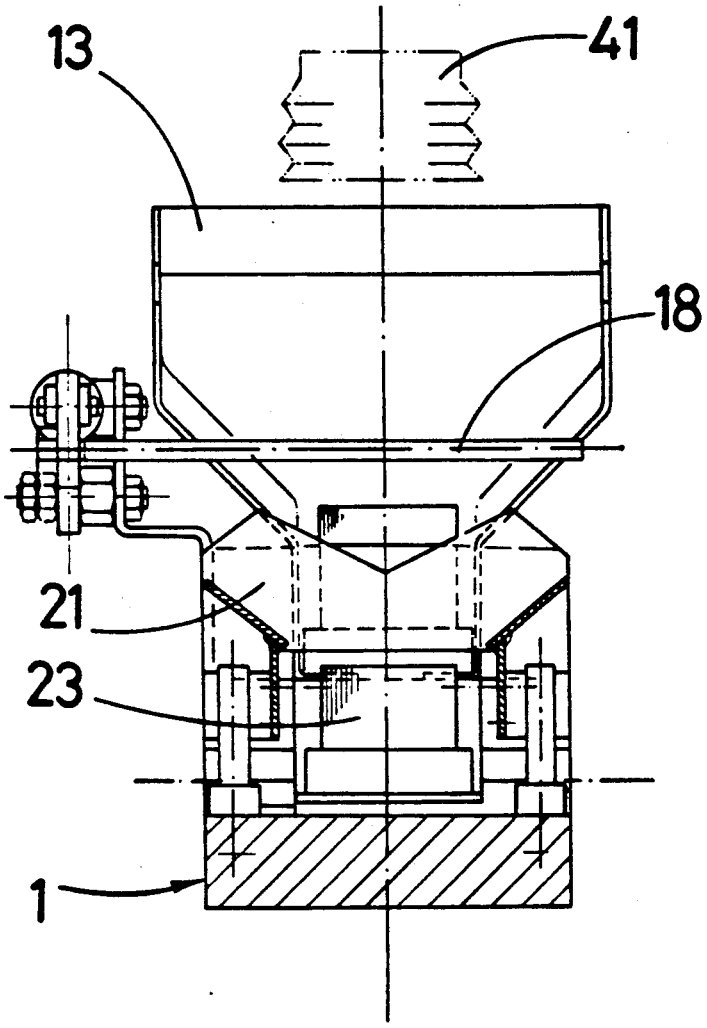

The coming out of the plunger or piston from the cylinder (20) causes the tilting of plate (19) and the consequent descent of the bar stop (18), permitting the passage and discharge of a unit of the products, which automatically arrange themselves in a row in the corresponding narrow vibratory duct (13) or (14), due to the specific configuration, dimensions and proportions of said narrow ducts and their own vibration and certain inclination toward their exit. The discharge of the products of each of the two rows, from each of the two narrow vibratory ducts, occurs over a respective concave support (21) and (22) —FIGS. 6, 7 and 8—, whose bottom is formed by a corresponding vibratory brush (23) and (24). The vibration of the brushes (23) and (24) is obtained simply by attaching them to the respective narrow vibratory ducts (13) and (14), while the concave supports (21) and (22) are fastened to the support structure (1) of the machine, it being desirable that this attachment should include means for regulating the height of said concave supports in accordance with the size of the products to be handled. In front of each of the two concave supports (21) and (22) a detector (25) and (26) is disposed to control the discharge, one by one, of the products transported by the respective narrow vibratory duct (13) and (14), with the cooperation of the respective bar stop such as stop (18).

Obviously, the vibrators and pneumatic cylinders described until now could be driven hydraulically or be replaced by other equivalent vibrating and displacement drive means.

The vibratory ducts and the concave supports serve to transport the products, and at the same time to place them—when they are more or less flat, as is the case with mandarins for example—with their flat base resting on the respective concave support, remaining in this position until they have been deposited on the respective container, which position they maintain therein, giving rise to a pleasing visual effect for the buyer of these products.

Figure 1:
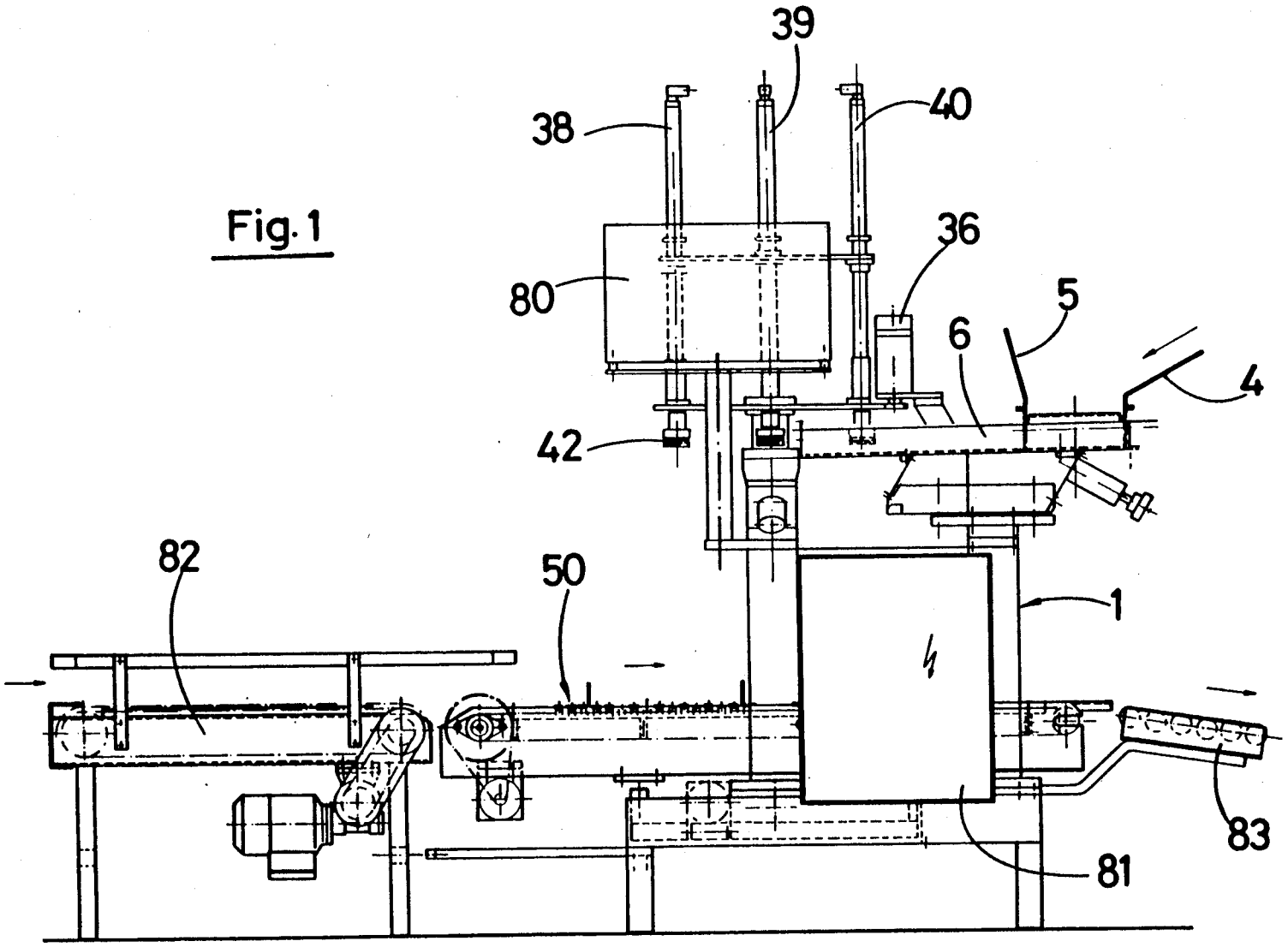
FIG. 1 shows a view in elevation of the right side member of the machine.

In the geometric center (27) —FIG. 6— and equidistant from the geometric centers of the two concave supports (21) and (22) lies the geometric axis (28) of a vertical shaft (29) of a rotating frame formed by said shaft (29), a horizontal disk (30) and two diametric horizontal arms (31) arranged crosswise, the shaft (29), disk (30) and pair of arms (31) being firmly connected together. Shaft (29), together with disk (30), is attached to a tubular sleeve (32) mounted, through bearings, for rotation about a column (33), which in turn is firmly connected by its lower part to the support structure (1) —FIGS. 1, 2 and particularly 6, 9 and 10—. Disk (30) may have cutouts or recesses to reduce its inertial mass.

The frame has a step-by-step movement, by an angle equal to the result of dividing 360° by twice the total number of concave supports and then multiplying by the number of rotating frames, which angle is, in this example of realization, 90° (90°=360°/2×2 concave supports×1 rotating frame). The step-by-step motion of the frame is obtained by means of the toothed rim (34) of disk (30). which meshes with a pinion (35) of a step-by-step motor (36), which is attached to the structure (1) of the machine.

Figure 9:
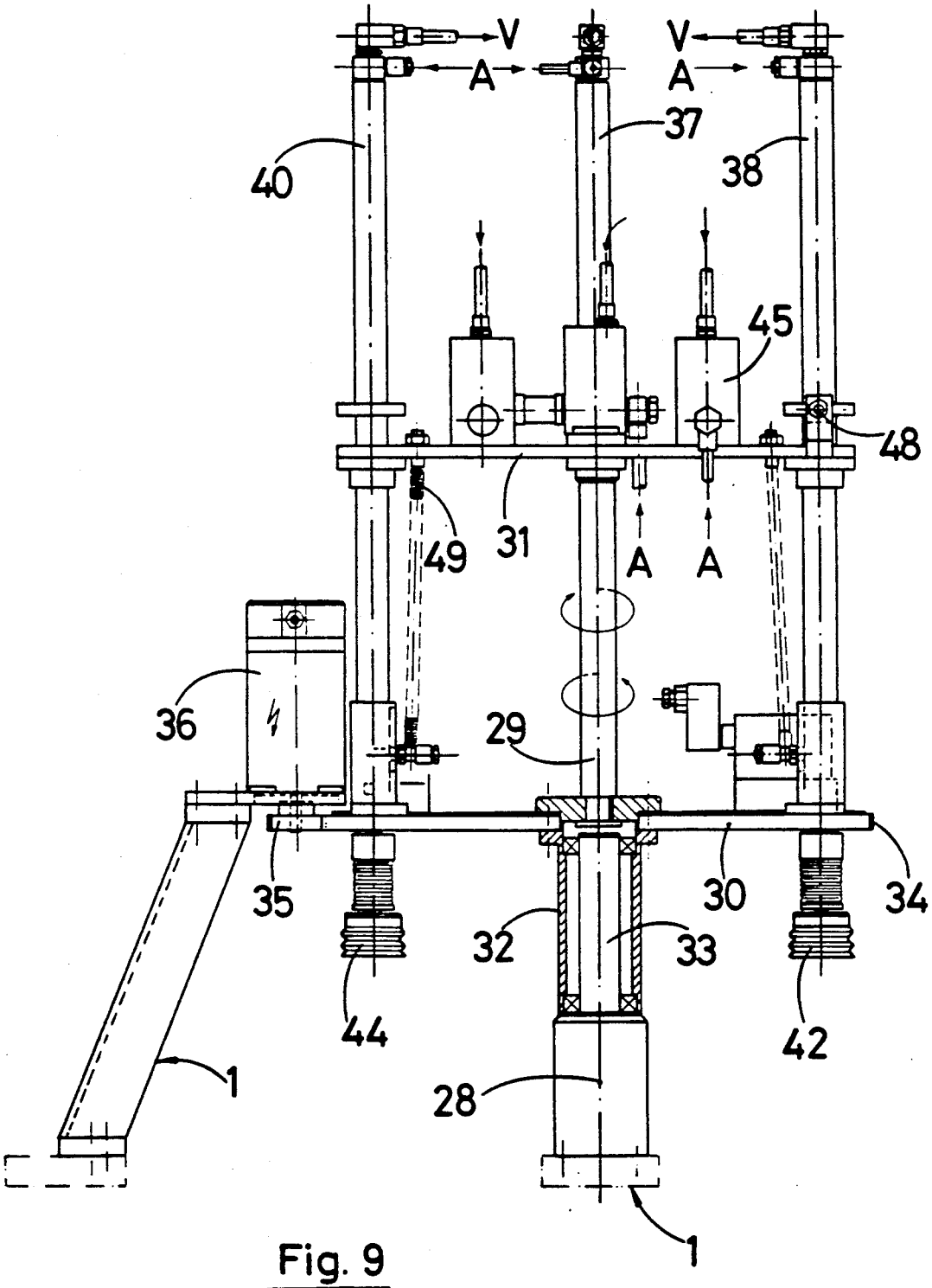
FIGS. 9 and 10 show, respectively, a view in elevation of the left side member and in plan of the product transporting means.
Figure 10:
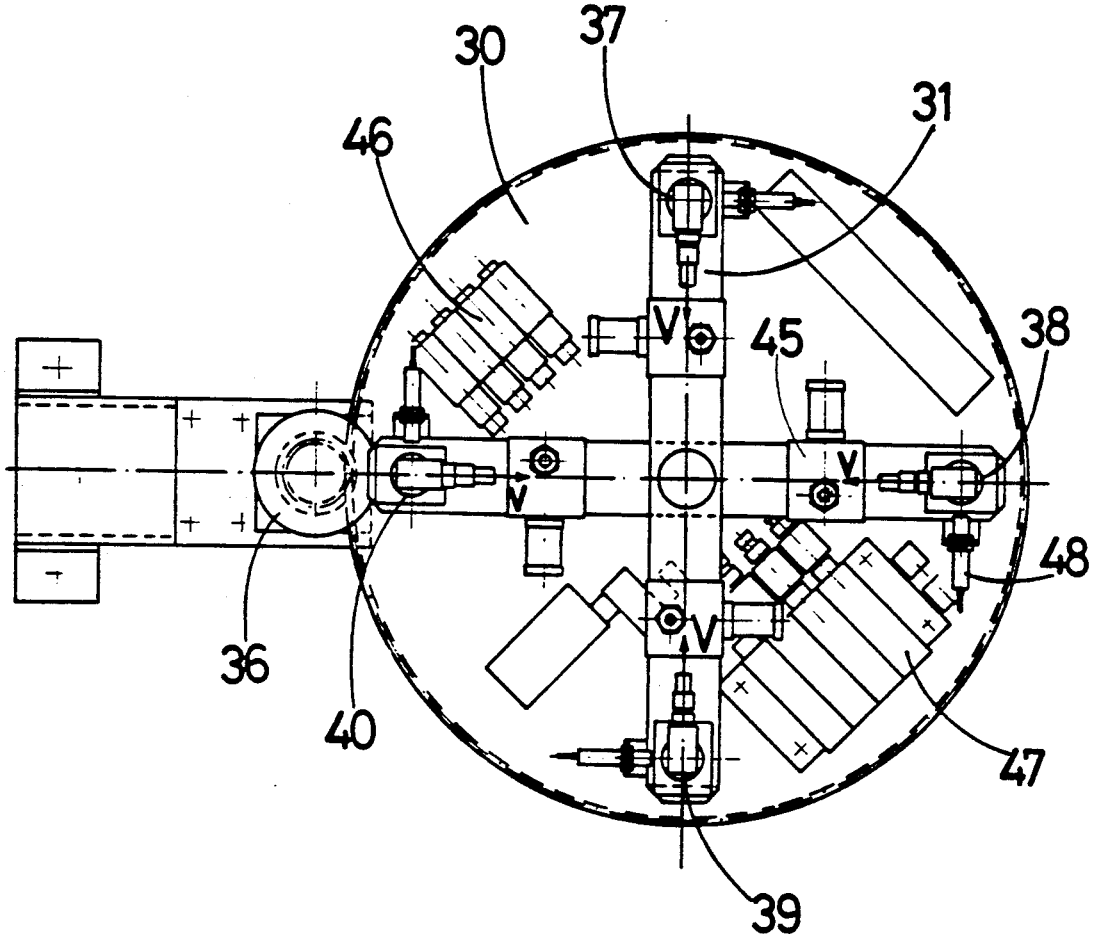

Mounted on the frame of this example are four vertical pneumatic cylinders (37, 38, 39, 40)—although they could be driven hydraulically or by another conventional system—which are arranged peripherally equidistant from each other by an angle equal to the step-by-step rotation of the frame, that is, in this case, by an angle of 90°, these cylinders having a special construction in that their piston is composed of two mutually telescoping tubular parts joined slidingly by means of seal joints, in such a way that the inner tubular part of smaller diameter is attached to the upper part of the cylinder and the outer part slides vertically up and down and has at its lower end a respective suction cup (41, 42, 43, 44) attached to said sliding pistons of the cylinders (37, 38, 38, 40). Through the interior of the two telescoping parts of the piston the suction is transmitted to the respective suction cup, the suction coming, in this example, from a source of vacuum such as (45) which is connected by a pipe to the upper part of the cylinder such as cylinder (38) and is indicated by V —FIGS. 9 and 10—. Each of these sources of vacuum produces the suction by Venturi effect, being connected for this purpose to the compressed air system, with insertion of a respective solenoid valve, such as (46) —FIG. 10—. Each of the vertical cylinders is connected to the compressed air source, marked by A —FIG. 9— with insertion of a respective solenoid valve such as (47).

The cylinders (37, 38, 39, 40) are mounted floating between the disk (30) and the two crossing arms (31) of the frame; they can slide along a certain vertical path limited by respective stops, and there are as many detectors of the displacement of each cylinder, such as detector (48), and there may also be an elastic spring for each cylinder, such as spring (49), to counterweigh the respective cylinder. When the telescoping piston slides down with its respective suction cup, lowering the product adhering thereto by suction, and when this product comes to apply against the container or against the layer of the container being filled, there occurs an upward displacement of the body of the respective cylinder, and its detector produces a signal which will give rise to a stop command in said descent, together with the stopping of the suction, and therefore the detachment of the suction cup from the product in question, and also there occurs its elevation to the position shown in FIG. 9; and when, from this position, the respective part of the telescoping piston with its suction cup descends until it rests on the product in one of the concave supports, there occurs in equal manner a certain rise of the body of the cylinder and the actuation of said detector which, through the process programming unit, causes the suction of the product by attachment to the suction cup and its elevation by the upward bend of the respective part of the telescoping piston as well as the rotation of the frame by the appropriate angle and its vertical descent onto the bottom of the container or onto the last layer laid on it, as explained before.

Figure 2:
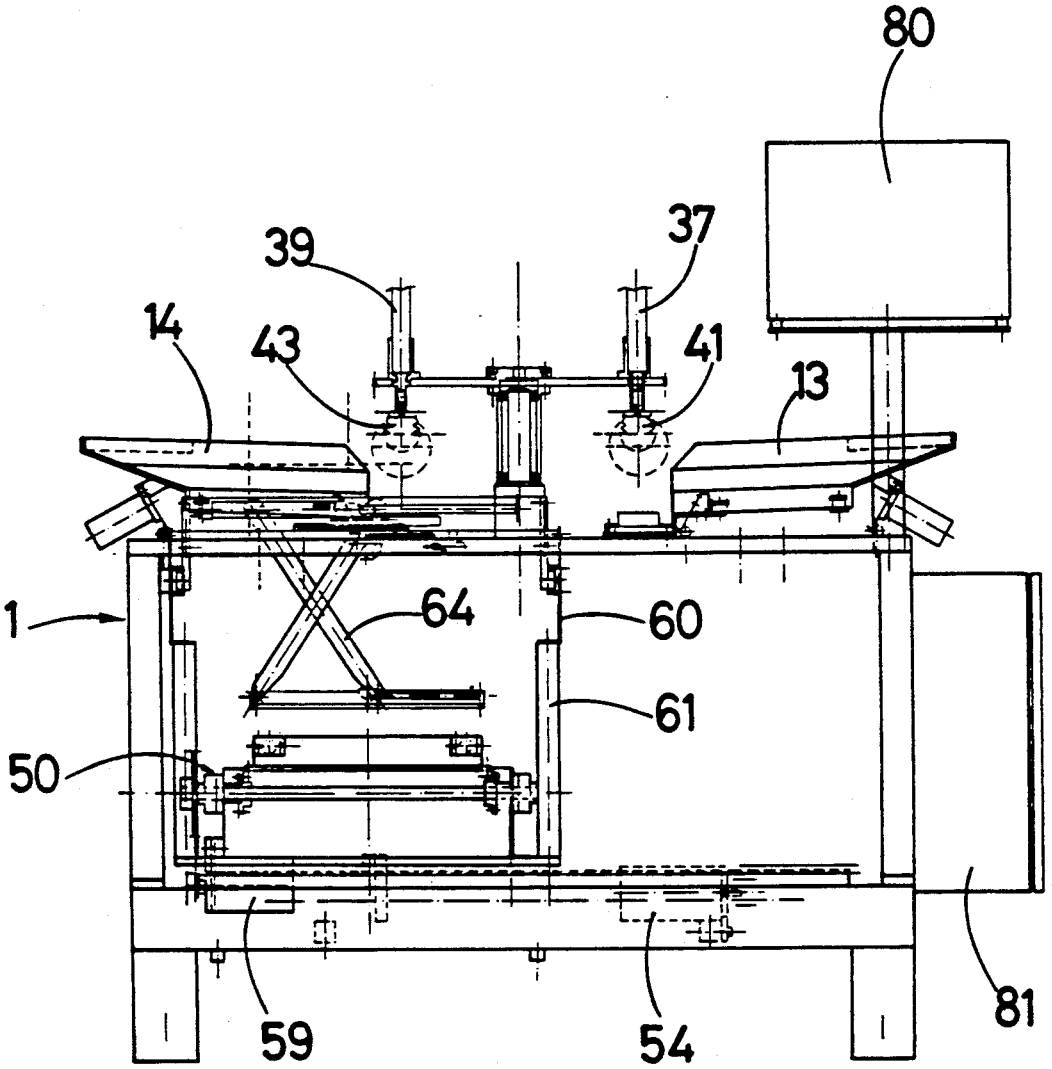
FIG. 2 is a front view.
Figure 3:
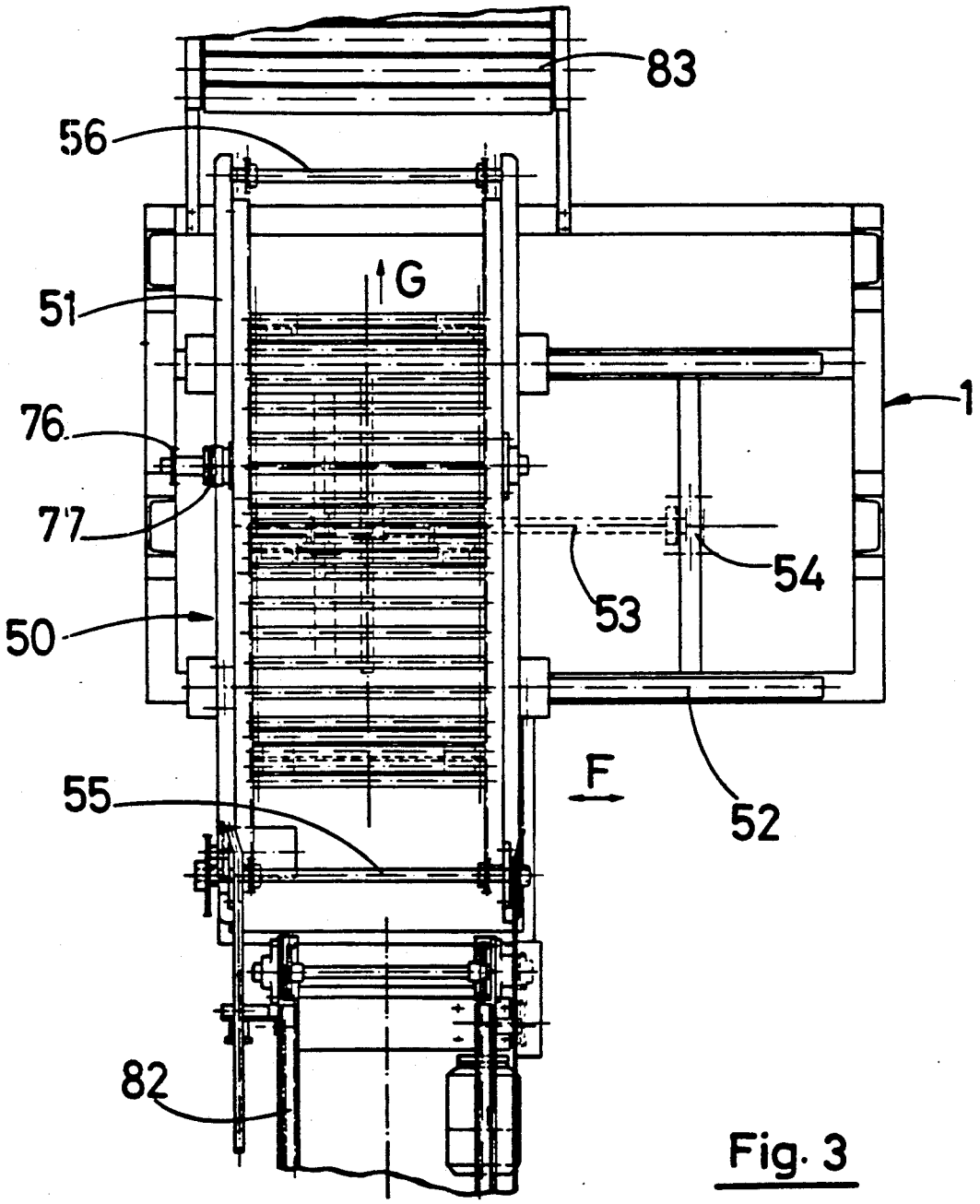
FIG. 3 a plan view.

The container transporting means (50) —FIGS. 1, 2, 3, 11 and 12— has a carriage (51) mounted on guide rails such as (52) for its transverse displacement relative to the longitudinal axis of the machine, considered in the direction of the displacement of the containers from their entry into the machine to their exit when full, which displacement is marked by the arrow F in FIG. 3. This transverse displacement is alternating, that is, from left to right and back as shown in FIG. 3, and is obtained, for example, by means of the spindle (53), driven clockwise or counterclockwise by the motor (54), the respective bolts and nuts being disposed on the displaceable carriage itself, although obviously such alternating transverse displacement means could be any other suitable ones.

Figure 11:
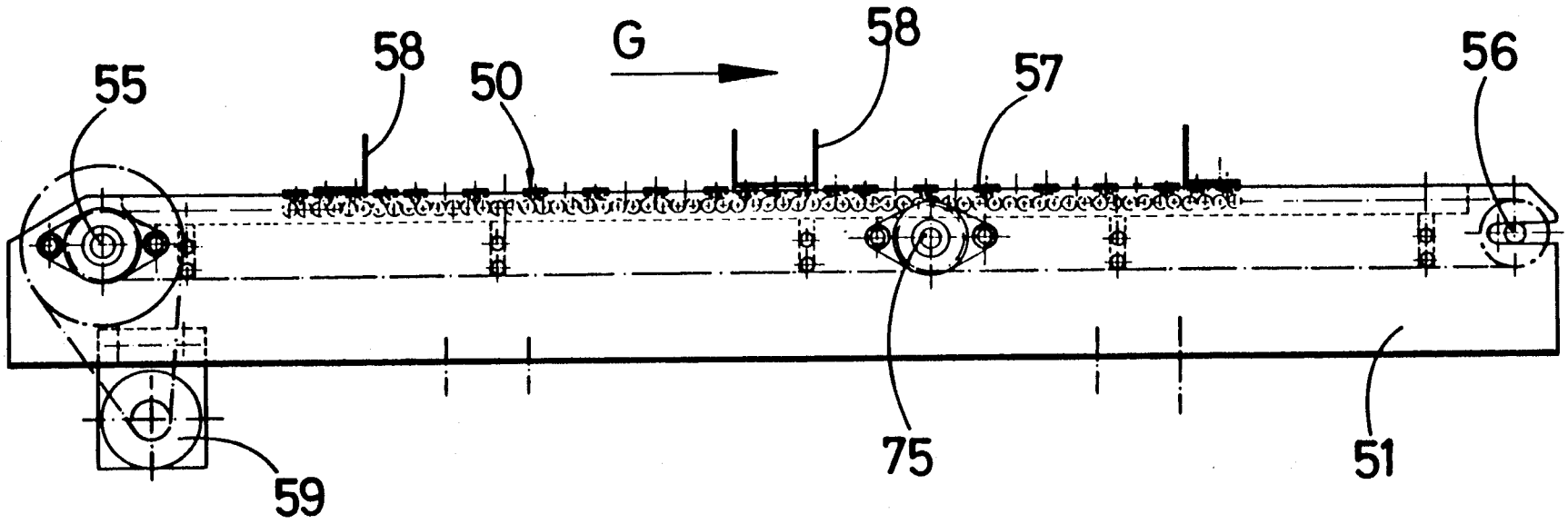
FIGS. 11 and 12 correspond to means of transportation of the containers, seen, respectively, in elevation of the right side member and in front view.
Figure 12:
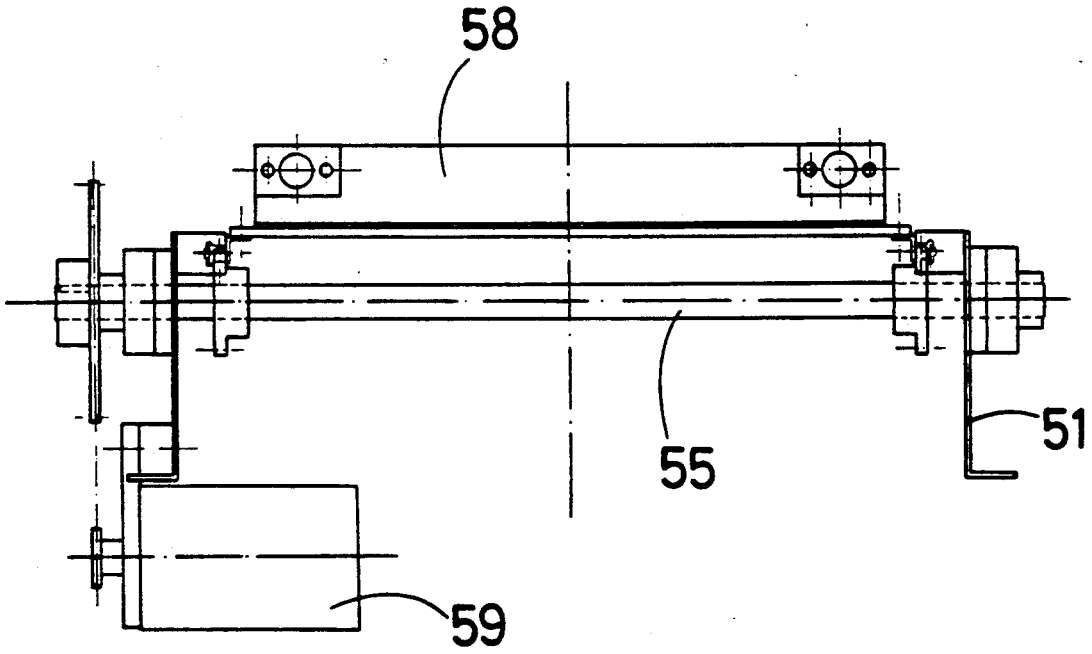
Figure 13:
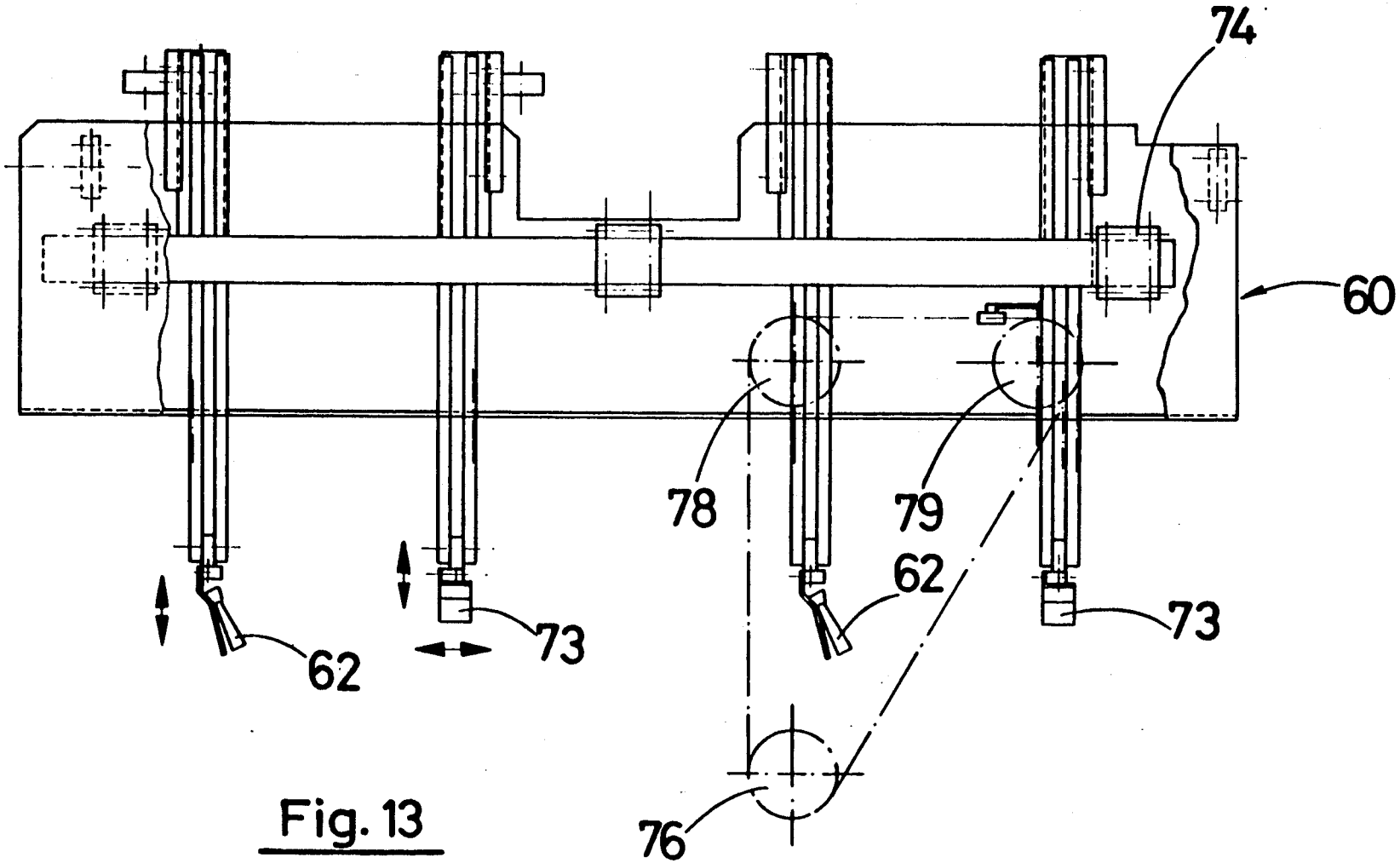
FIGS. 13, 14 and 15 represent the transverse barrier means and the means for holding the rows of products, seen, respectively, in elevation of the right side member, in front view, and in plan.

The carriage (51) comprises a rigid frame with two longitudinal endless chains mounted on respective sprockets disposed at two transverse end axles (55, 56); transversely fastened to said two chains are the series of slats (57) which support and transport the containers being handled from the entrance to the exit of the machine; in this case these are two containers to be filled simultaneously, and the stops (58) for retention of such containers, said slats and stops being arranged as shown in FIG. 11 and also in FIG. 3; in the case of this example where two containers are filled with products, this assembly of slats and stops occupies only the part of the total development of the two chains which is shown in FIG. 11, but if more than two containers are to be filled simultaneously, this means of transporting them by moving them in the direction indicated by arrow G in FIGS. 3 and 11 would have to be enlarged accordingly.

The drive of said means of transporting the containers to be filled, which is here intermittent and step by step, is obtained by means of a suitable motor (59) and through the respective transmissions—chains or belts and sprockets or pulleys.

Figure 14:
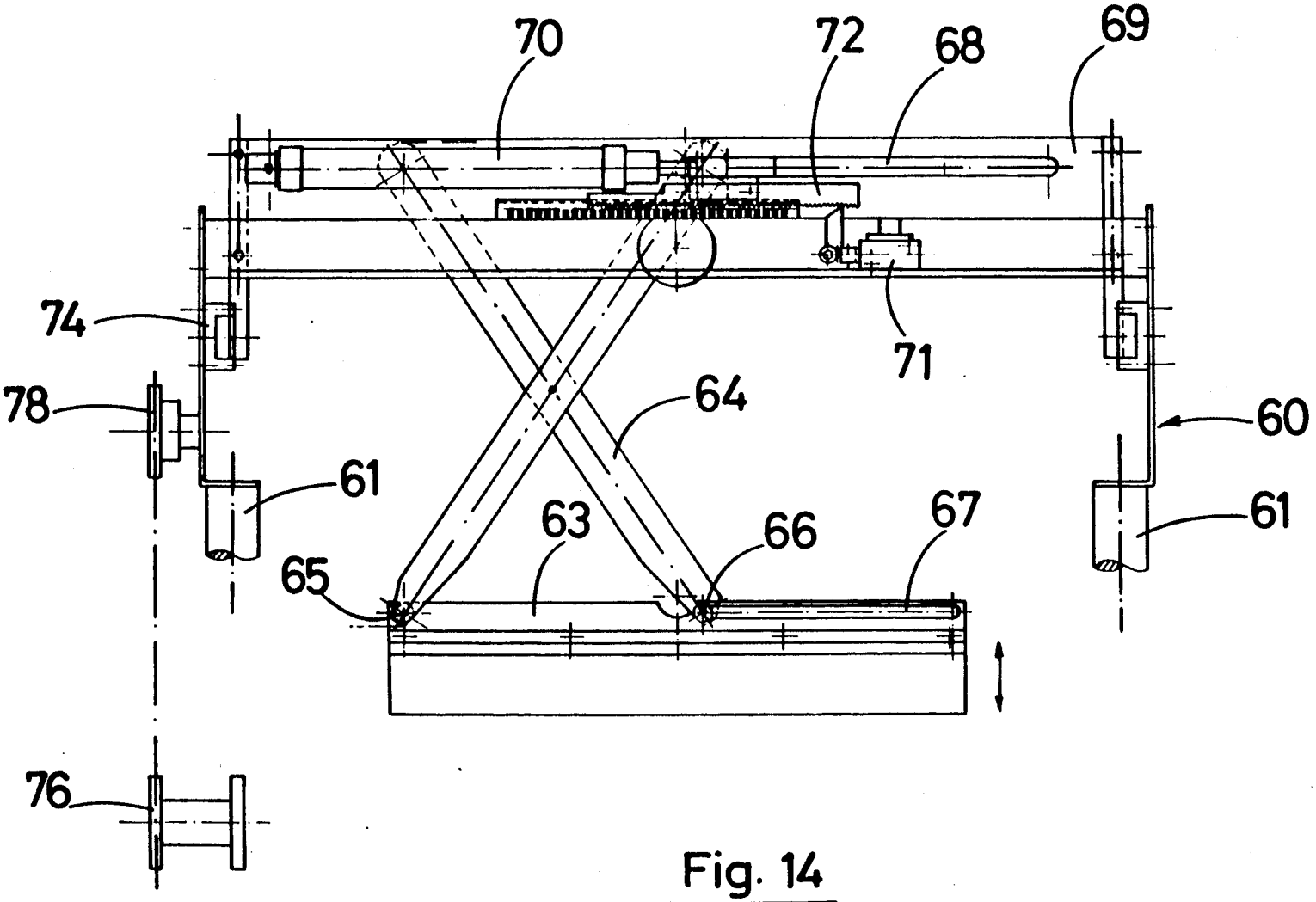
Figure 15:
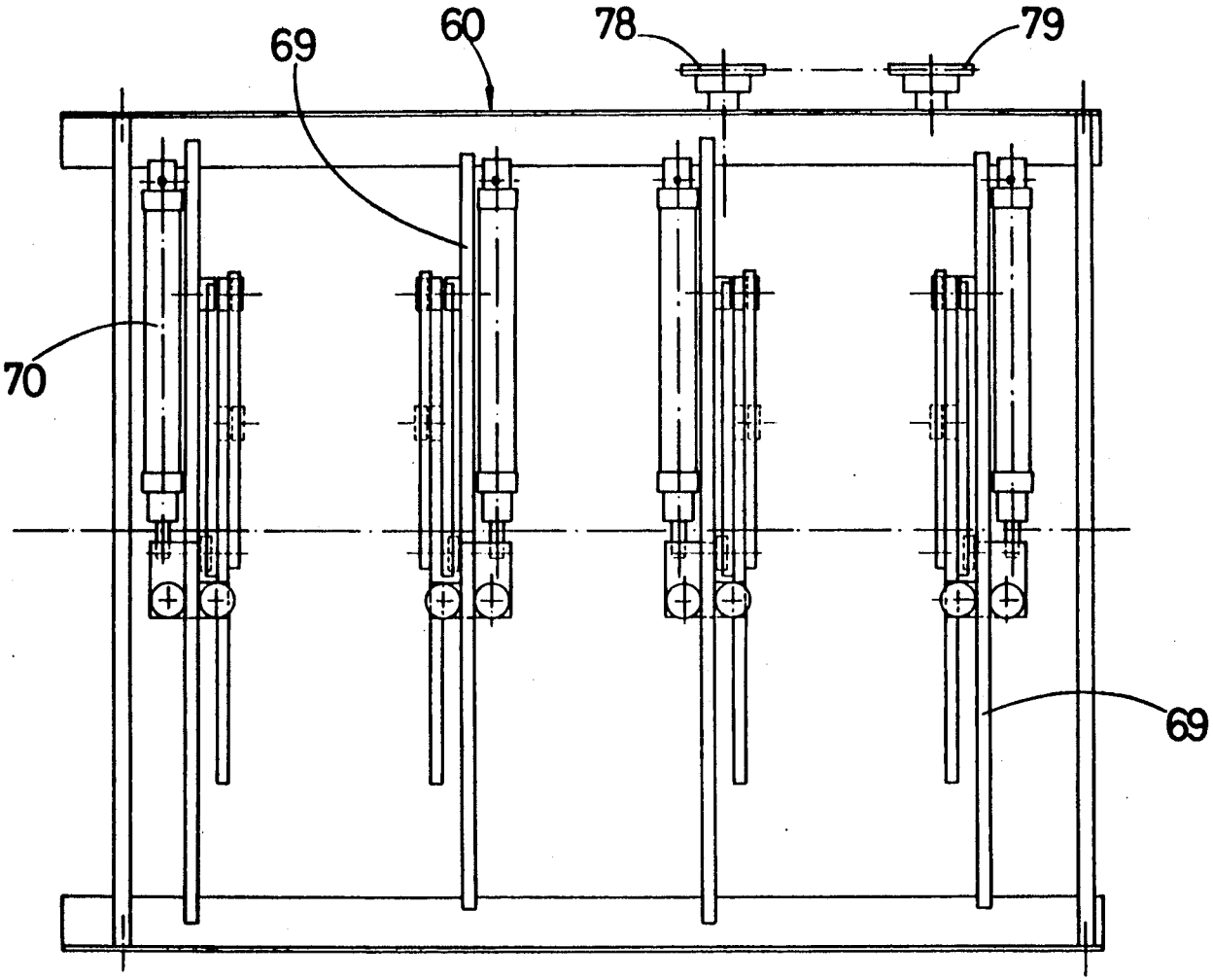

Carriage (51) presents an upper chassis (60) —FIGS. 2, 13, 14 and 15—, placed parallel to said carriage and at a certain height above it; the chassis is fixed to the carriage for example by four vertical pillars such as (61) —FIGS. 2 and 14—. At this upper chassis (60) is disposed a pair of transverse barrier means for keeping the products in position during the formation of the rows of each layer in the pair of juxtaposed containers which in this example of realization of the filling machine are filled simultaneously, so that the number of transverse barrier means must coincide with the number of containers to be filled simultaneously; and also there is disposed in said upper chassis a pair of upper transverse holding means for each row of products formed in each of said two juxtaposed containers, and it should be pointed out that the number of transverse holding means must also coincide with the number of containers to be filled simultaneously in the respective machine.

The transverse barrier means referred to are attached to the chassis (60) and each of them consists of a transverse brush such as (62), suitably fastened to a transverse rule which can slide vertically up and down (to reach its upper inactive or resting position and to descend to its working or active position at the height of the bottom of the container or of the respective layer to be formed). Said rule such as (63) —FIG. 14— has hinged to it two scissor arms (64) hinged together, so that the lower end of one such arm is hinged at a fixed point of the rule such as point (65) and the lower end of the other arm is hinged at an axle (66), displaceable horizontally along the groove (67) of the rule; while the upper end of the scissor arm opposite the axle (66) is hinged at a fixed point of the chassis (60), whereas the other upper end of the other scissor arm opposite point (65) is hinged at an axle displaceable horizontally along the groove (68) of a transverse plate such as plate (69) of the same chassis (60) —FIGS. 14 and 15—. The raising or lowering of each brush (62) occurs by means of a pneumatic cylinder such as (70), which might be hydraulic or any other conventional controlled drive means, the rod of which is articulated at its free end to the upper end opposite point (65) of the respective scissor arm (64), its displacement being regulated by means of a device such as (71) which meshes with a toothed piece such as (72), and there is provided also an arrangement of consecutive transverse windows for detection of the position of the articulated free end of the piston of cylinder (70) and hence detection of the position in height of the brush (62). Obviously, the described displacement regulation and the mentioned detection of the position in height of the brush may be obtained by any other suitable means.

The transverse holding means, in this case two as indicated before, consist of a strip such as (73), preferably elastic or fluffy to some degree to permit pressing them gently onto the row of products already formed in each of the juxtaposed containers to be filled simultaneously and mounted in the same manner as set forth above for the transverse barrier means, simply by replacing the brush (62) by said strip (73), with the following differences in the mounting of the pair of transverse barrier means: The upper transverse holding means, two in this case, of each row of products already formed in each of the juxtaposed containers have means for their alternating longitudinal displacement relative to the chassis (60), and hence relative to the carriage (51), for which purpose the two holding means in question are joined together and mounted so as to be able to slide longitudinally relative to the chassis (60) owing to guide means such as (74); and this alternating longitudinal displacement is coordinated, as to the movement toward the exit of the containers, with the intermittent forward movement of the containers while they are being filled, this displacement being equal to the separation between the axes of a row of products from the following row still to be formed; to this effect and to coordinate such displacement toward the exit of the machine, the carriage (51) has an intermediate transverse shaft (75), properly supported between the longitudinal side members of said carriage and linked by a respective gear meshing with at least one of the two endless chains of the carriage and which presents, at its left end, a gear (76) and a clutch (77) disposed between said end gear and the rest of the shaft —FIGS. 3 and 11—, gear (76) being linked, through a respective chain —FIGS. 13, 14 and 15—, with two additional gears (78, 79), rotatably mounted on chassis (60) and disposed so as to define a horizontal strand of said chain, to which is fastened the corresponding transverse holding means (which in turn is attached to the other) to produce a synchronized displacement of said pair of transverse holding means and of the container transporting means, that is, their displacement according to arrow G —FIGS. 3 and 11—, and therefore the pitch diameters of the gears (76, 78 and 79) are equal; the drawings do not show the union between the two transverse holding means or the attachment of one of them to the horizontal upper strand of the chain between the gears (78) and (79).

The two upper transverse holding means of each product row formed in each of said pairs of juxtaposed containers present their strips (73) in their highest position when they are at rest and located next to their respective transverse barrier means (position not shown in FIG. 13); they are made to descend onto the top of the product row just formed owing to said brushes (62); thereafter the pair of containers being filled are moved toward the exit of the machine (toward the right in FIG. 13), with a displacement equal to the separation between the axes of the product row formed and the next one to be formed in each of said containers, the pair of transverse holding means being displaced synchronized with the containers, a pressure being maintained on the respective product row formed, holding them down sufficiently without damaging them, until the containers have moved in the amount stated, at which moment said two strips may, if desired, be displaced upward again and the next product row to be placed between the previous row and the respective brush may be formed, although it is considered desirable to maintain the upper constraint of the formed row while the next one is being formed, in which case the transverse holding means continue to keep the strips (73) in their active position until the next row has been formed, at which time they are moved upward, then longitudinally and then downward to hold down the last-formed product row, and the described cycle repeats.

The control and regulation of the various operating phases, which includes various spatial distributions selectable by the user of the products in the containers and in accordance with the capacity of the latter, is carried out by means of a process programming unit (80) which enables the user to select a distribution according to the length and width of the container for each layer and the relative distribution of layers to each other, taking into account the height of the container.

There is also a cabinet (81) containing the electric controls amd any adjustment means of the kind; adapted to the machine may be a conveyor (82) of empty containers, placed in front of the entrance to the machine, as well as another conveyor (83), for example one operating by gravity, for the pair of full containers; it is placed at the exit from the machine. In any case, the machine will be coupled to the installations existing in the place where the products with which the containers are to be filled are handled, in accordance with the needs and own installations of the respective subsections. Through the process programming unit the user first selects a spatial distribution of the products in the containers to be filled with them, that is, the number of layers of products, the configuration of each layer and that of the layers among themselves, in accordance with the size of the products and with the dimensions of the two containers to be filled simultaneoously in the machine. After the machine has been started and a pair of containers brought from the conveyor (82) to the transport means (50) of this pair of containers in the filling zone of the machine, transportation of the products to the entrance of the machine is started by the simultaneous feed means for the products, discharged onto the pair of endless belts (2) and (3), continuing through the two vibratory ducts (6) and (7) and passing to the narrow vibratory ducts (13) and (14), said pair of simultaneous feed means stopping when the detection means in the zones of transition between each belt and the ducts (6) and (7) indicate that the narrow ducts (13) and (14) are full of product. In the vibratory ducts (13) and (14) the products are arranged in as many rows and discharged one by one, owing to the respective bar stop (18), on the corresponding concave support wherein, if the products are more or less flat, they are arranged with their flat base on the respective support, for the reasons set forth in the above description.

The frame which constitutes the means of transporting the products from the concave supports until they are deposited in orderly manner in the pair of containers to be filled or being filled, is disposed so that the pair of suction cups (41) and (43) go down through the respective actuation of their cylinders (37) and (39) until they strike at the top each of the two products disposed in the pair of concave supports (21) and (22), and by suction through the respective telescoping pistons they constrain these products, which are immediately raised and then a counterclockwise rotation of 90° occurs, thereafter the telescoping pistons descend and hence also the two products subjected to the suction cups, these products being arranged as first element of the first row of each of the two containers being filled simultaneously, for which purpose the carriage (51) of the container transporting means (50) is disposed as shown in FIG. 3, and said container transporting means has arranged them so that their filling begins from the right rear corner, in this example and in this assumed position. While the pair of products is discharged as stated, onto the pair of containers being handled, the other two suction cups (42) and (44) of the remaining pair of vertical cylinders (38) and (40) have rotated counterclockwise by the rotation of the frame in said direction and in turn pick up by suction another pair of products that have been discharged onto the two concave supports referred to, so that, when the two suction cups (41) and (43) cease to hold the first two products, the pistons of the cylinders (38) and (40) rise to their highest position and the frame makes a clockwise rotation of 90°, bringing down the two telescoping pistons with the suction cups (42) and (44), depositing the second pair of products on the pair of containers being filled and arranging them as second element of the first product row being formed, always with the aid of the corresponding transverse barrier means or brushes; the alternating phases are repeated, and it should be indicated that the rotary movement of the frame is preferably alternating as to its direction of rotation, that is, one step in one direction and the next in the opposite direction, to simplify the electric and pneumatic lines, although such movements might be step by step but in the same direction, in which case the electric connections should be made through contact means such as brushes or through electromagnetic induction means and the pneumatic lines should be have rotary joints to maintain the passage of the fluid under corresponding pressure, without impeding said rotation in the same direction as the frame. Whenever a unit of product has been deposited in each container, the carriage (51) moves transversely a distance equivalent to the separation between the longitudinal axes of the product columns to be formed, owing to the step motor (54) and the rotation of the spindle (53).

When the first product row has been obtained in each of the two containers, the respective transverse holding means descend; they press on the products of this row, holding them sufficiently without damaging them, and there occurs a longitudinal advance of the container transporting means (50) toward the exit of the machine and hence of the containers, with a displacement equal to the separation between the axis of this formed row of products relative to the axis of the next row to be formed, with an identical and synchronized displacement of the transverse holding means with its strip (73), to keep said first row in its correct position; the cycle repeats for the next row which, when completed, is held down by the strips of the transverse holding means, for which purpose the latter rise relative to the first row and descend, applying in the manner stated against the second row, and so forth until the first layer of products in said two containers has been packaged; it is evident that to go on displacing the pair of containers along the transverse axis of the machine for a distance equal to the separation of the longitudinal axes of the columns to be formed with the elements of the rows being formed, the carriage is being displaced in equal amount from its extreme left position relative to the pair of containers being filled to its extreme right position, by a distance approximately equal to the width of the containers being handled, whose transverse displacement takes place owing to the rotation of the spindle (53) in the desired direction, driven by the motor (54); it should be pointed out that the filling of the elements of one row occurs in a given transverse direction and the filling of the next row in the opposite direction, thus avoiding idle movements of the carriage.

When the packaging of one layer is finished, the packaging of the next can be begun, in an arrangement, if desired different from the previous one to ensure the stability of the products making up the second layer relative to the first, but always in the special arrangement predetermined and regulated by the user of the machine through the process programming unit. After the two containers are filled, they are transported to the exit of the machine by the transport means (50) and possibly discharged through the gravity conveyor (83), the complete cycle repeating over again to fill another pair of containers, which complete cycle is controlled and regulated basically by the process programming unit and by means of the detectors and motors with their respective transmissions to which express reference has been made in the course of the present description. The second layer is completed after the barrier means and holding means have been prepared at the appropriate level, and likewise for one or more successive superposed layers.

It should be mentioned that in the realization of the machine for filling containers with products in a predetermined distribution, according to the invention, all the variants of detail which experience and practice may suggest with respect to forms and dimensions, both absolute and relative, the number of parts, the materials employed therein and other circumstances of an accessory nature may be applied, and any modifications of structural detail that are compatible with the essence of what has been claimed may be introduced, as all this is comprised in the spirit of the following claims.

What is claimed is:

1. Machine for filling containers with a product, comprising: product supplying means for supplying said product to be packed, including at least a pair of simultaneous feed means, each ending in at least a corresponding pair of transport ducts, each of which discharges the product;

product transporting means for transporting the product from said product supplying means in rows to two separate containers; and container transporting means having means for advancing said separate containers to be filled longitudinally and perpendicularly to said rows, and being mounted on a carriage, and said carriage including means for alternate displacement of said carriage transverse to said advancement and at least one pair of barrier means coordinated with the containers to be filled, to keep the product in position in the containers during the filling operation so that said separate containers are filled simultaneously, and said carriage further including at least one pair of holding means for each previously formed row of products filled into each of said containers, the holding means having means for alternate longitudinal displacement, and the longitudinal displacement of the holding means being coordinated with movement of the containers as the containers are being filled.

2. A machine according to claim 1, wherein said product supplying means arranges said products in a row and discharges said products, one by one, onto a concave support having a bottom formed by a vibratory brush.

3. A machine according to claim 2, wherein said product transporting means includes at least one frame rotating about a vertical axis, with a step-by-step movement and by an angle equal to the result of dividing 360° by twice the total number of concave supports and then multiplying by the number of rotating frames, said vertical axis being situated at a point equidistant from the centers of the respective concave supports, and said frames having a vertical pneumatic cylinder disposed peripherally equidistant from each other and at an angle equal to that of the step-by-step rotation of the frame.

* * * * *